US009234332B2

(12) United States Patent
Marchand

(10) Patent No.: US 9,234,332 B2
(45) Date of Patent: Jan. 12, 2016

(54) MECHANICAL SYSTEM FOR CONNECTING A WEARING PART AND A SUPPORT THEREOF, AND METHOD FOR IMPLEMENTING SAID SYSTEM

(75) Inventor: Fabrice Marchand, Saint Galmier (FR)

(73) Assignee: SAFE METAL, Lyons (FR)

( * ) Notice: Subject to any disclaimer, the term of this patent is extended or adjusted under 35 U.S.C. 154(b) by 60 days.

(21) Appl. No.: 14/239,850

(22) PCT Filed: Aug. 31, 2012

(86) PCT No.: PCT/EP2012/066961

§ 371 (c)(1),
(2), (4) Date: Apr. 8, 2014

(87) PCT Pub. No.: WO2013/030336

PCT Pub. Date: Mar. 7, 2013

(65) Prior Publication Data

US 2014/0223785 A1 Aug. 14, 2014

(30) Foreign Application Priority Data

Sep. 1, 2011 (FR) ..... 11 57733

(51) Int. Cl.
*E02F 9/28* (2006.01)

(52) U.S. Cl.
CPC ..... *E02F 9/2841* (2013.01); *E02F 9/2825* (2013.01); *Y10T 29/49948* (2015.01)

(58) Field of Classification Search
USPC ..... 37/455–457
IPC ..... E02F 9/2816,9/2825, 9/2833, 9/2841
See application file for complete search history.

(56) References Cited

U.S. PATENT DOCUMENTS 4,716,668 A * 1/1988 Hahn ..... 37/458
4,727,663 A * 3/1988 Hahn ..... 37/458
5,435,084 A 7/1995 Immel (Continued)

FOREIGN PATENT DOCUMENTS

FR 2 878 871 A1 6/2006
GB 2 134 965 A 8/1984

(Continued)

OTHER PUBLICATIONS

International Search Report, dated Nov. 19, 2012, from corresponding PCT application.

(Continued)

*Primary Examiner* — Gary Hartmann
(74) *Attorney, Agent, or Firm* — Young & Thompson

(57) ABSTRACT

A mechanical system (1) includes a support (10), a tooth (20) and a device (30) for interconnecting the two components. The device (30) includes a key (50), a nut (60) and an elastic sheath (40) provided with a wall that is adjustable by deformation in a housing (14) of the support, by screwing between the key and the nut, between an insertion configuration and a locking configuration. The device (30) also includes a support ring (70) inserted between the key and an opening (24) made in the tooth (20). In the insertion configuration of the device (30), the support ring (70) is adjusted in the opening (24), while in the locking configuration of the device (30), the support ring (70) exerts retaining forces on the tooth (20). A heavy-construction machine bucket (G) including such a system (1), and a method for implementing such a system are also described.

10 Claims, 5 Drawing Sheets

(56) References Cited

U.S. PATENT DOCUMENTS

| | | | | |
|---|---|---|---|---|
| 6,079,132 | A * | 6/2000 | Clendenning | 37/457 |
| 6,092,958 | A * | 7/2000 | Gale | 403/378 |
| 7,640,685 | B2 * | 1/2010 | Emrich | 37/457 |
| 7,980,011 | B2 * | 7/2011 | Ruvang | 37/452 |
| 2007/0261278 | A1 | 11/2007 | Campomanes | |
| 2009/0205228 | A1 | 8/2009 | Ruvang | |
| 2014/0245645 | A1 * | 9/2014 | Marchand | 37/444 |
| 2014/0298692 | A1 * | 10/2014 | Marchand | 37/444 |

FOREIGN PATENT DOCUMENTS

| | | | |
|---|---|---|---|
| JP | 50 026302 | A | 3/1975 |
| JP | 55 050200 | U | 4/1980 |

OTHER PUBLICATIONS

French Search Report, dated Mar. 28, 2012, from corresponding French application.

* cited by examiner

MECHANICAL SYSTEM FOR CONNECTING A WEARING PART AND A SUPPORT THEREOF, AND METHOD FOR IMPLEMENTING SAID SYSTEM

The present invention relates to a mechanical system comprising a support, a wearing part and a connection device between the wearing part and its support, in particular a tooth and its support belonging to a piece of heavy-construction machine equipment. The invention also relates to a heavy-construction machine bucket comprising at least one such system. Lastly, the invention relates to a method for implementing such a system.

The invention relates to the field of heavy-construction machine equipment, in particular the buckets, hoppers or other receptacles that may scrape, remove and transport materials so that they may be evacuated from a given location to other workstations using heavy-construction machines.

BACKGROUND OF THE INVENTION

In a known manner, a bucket includes a leading blade equipped with wearing parts provided for their ability to penetrate the material and protect the other elements making up the bucket. Fastened on the leading blades are support-adapters having a profile nose, while the wearing parts are teeth or shields that are positioned on the support-adapter using a precise connection. This connection is temporary so that the wearing parts can be replaced after wear.

The connection between the wearing part and its support may be done by keying. To be high-performing, the keying devices must provide a rigid connection of the elements that they join. Traditionally, the assembly and disassembly of the keyings is done by using striking tools, which create a risk of injury for operators.

Also known are keying devices that do not require the use of striking tools. In that case, special restrictive equipment is necessary, in particular to disassemble the wearing part. Furthermore, the known devices are complex to manufacture and use.

FR-A-2 878 871 describes a keying connection device between a wearing part and its support. In the example of FIGS. 5 to 7, the device comprises two metal cylinders that screw onto one another and a rubber sheath placed between them. The screwing of the two cylinders deforms the sheath in a housing of the support, while the cylinders are housed in orifices of the wearing part. The connection provided by such a device lacks rigidity, efficiency and reliability. In particular, the cylinders are not systematically in a rear contact position to ensure retention of the tooth.

US-A-2009/205228 describes another connection device between a wearing part and its support. This device comprises a key, a nut, a sheath and a bearing ring. The sheath is positioned in a housing of the support. In an insertion configuration of the connection device, only the key, the nut and the ring are removable from this housing. The sheath cannot be removed from that housing without disassembling the tooth. When the device is inserted into the housing, the action of a tool makes it possible to produce a forcible engagement by friction between the key and the sheath on the one hand, and the nut and the sheath on the other hand, at the different tapered surfaces formed on those component elements of the connection device. The sheath includes a rib which, by bearing in a slot formed in the housing of the support, prevents the connection device from rotating under the action of the tool. The material of the sheath is not elastically deformable, for successive assemblies and disassemblies, under the operation conditions of the invention. This device is not fully satisfactory, in particular in terms of ease of use and wear resistance.

SUMMARY OF THE INVENTION

The aim of the present invention is to propose an improved connection device, making it possible to eliminate striking operations for the assembly and disassembly of the wearing parts. In particular, the invention relates to a connection device by keying that is high-performing, reliable, strong, simple and practical.

To that end, the invention relates to a mechanical system comprising a support, a wearing part and a connection device between the wearing part and its support, in particular between a bucket tooth and its support that belong to a heavy-construction machine, the connection device comprising:

- a key including a body that is elongated along the key axis between a threaded foot and a head,
- a nut capable of being screwed on the threaded foot of the key, and
- a sheath made from an elastically deformable material, provided with a wall arranged around the body and adjustable by deformation in a housing of the support, by screwing between the threaded foot of the key and the nut, between an insertion configuration where the connection device can be removed from the housing and a locked configuration where the wall of the sheath is adjusted in the housing.

The mechanical system is characterized in that:

- the connection device also comprises a bearing ring inserted between, on the one hand, an orifice formed in the wearing part across from a through opening of the housing and, on the other hand, the key rotatable in the bearing ring by screwing around the key axis,
- in the insertion configuration of the connection device, the bearing ring is adjusted in the orifice, and
- in the locked configuration of the connection device, the bearing ring exerts retaining forces on the wearing part.

The invention thus makes it possible to produce a rigid connection between the wearing part, in particular a bucket tooth, and its support, with considerable simplicity and high performance levels. Owing to the bearing ring, which is adjusted in the orifice formed in the toot both in the insertion configuration and the locked configuration, the device is systematically in the rear contact position to retain the tooth in the locked configuration. The key, the nut, the sheath and the ring are removable from each other in the insertion configuration and secured in the locked configuration. Furthermore, owing to the elastically deformable material of the sheath, the connection device can be adjusted in a satisfactory manner in the housing of the support and is well suited to several successive assemblies and disassemblies during use. The key, the nut, the sheath and the ring are removable from each other in the insertion configuration and secured in the locked configuration. As a result, the connection device according to the invention is easy to manufacture and use. The mechanical system can be assembled and disassembled much more quickly and with a reduced risk of injury.

According to other advantageous features of the invention, considered alone or in combination:

- In the locked configuration, the bearing ring exerts retaining forces, on the one hand, on a side surface of the orifice and, on the other hand, on a through shoulder of the orifice.
- The orifice and the bearing ring have complementary side surfaces globally centered on a secondary axis offset by a gap parallel and radially to the central axis of the housing.
- The orifice and the bearing ring include anti-rotation securing elements during screwing.

The head of the key includes rigid ribs that extend radially and parallel to the key axis and which are, one the one hand, engaged in a elastically deformable ribs formed in the bearing ring both in the insertion configuration and the locked configuration and, on the other hand, during screwing of the key, rotatable around the key axis by elastically deforming the ribs of the bearing ring.

The bearing ring is made up of a rigid outer part that is adjustable in the orifice and an elastically deformable inner part in which the key is positioned, the rigid outer part and the elastically deformable inner part being secured in rotation, in particular by gluing or thermofusing.

The nut includes at least one flat capable of cooperating, both in the insertion configuration and the locked configuration, with a corresponding platform in a part of the housing.

The support includes a through conduit into the housing on a side opposite the through opening and the orifice, the wearing part includes a through conduit on the side opposite the orifice, and the conduit of the support and the conduit of the wearing part are substantially aligned and capable of receiving a tool penetrating inside the housing, when the mechanical system is assembled, in particular that are capable of receiving a tool penetrating as far as a receiving part for receiving the nut in the housing.

The invention also relates to a heavy-construction machine bucket, comprising at least one mechanical system as described above. In practice, the bucket generally comprises a series of supports each receiving a tooth, which behaves like a wearing part and is secured to its support by a connection device.

Alternatively, other heavy-construction machine equipment may also be equipped with the mechanical system according to the invention.

Lastly, the invention relates to a method for implementing a mechanical system as described above. The method is characterized in that it comprises the following steps:

a) assembling the connection device;

b) positioning the wearing part on the support;

c) positioning the connection device in the housing of the support, in the insertion configuration where the bearing ring is adjusted in the orifice and the connection device is removable from the housing;

d) deforming the sheath in the housing by screwing the threaded foot of the key into the nut;

e) stopping the screwing in the locked configuration where the wall of the sheath is adjusted in the housing and the bearing ring exerts retaining forces on the wearing part.

BRIEF DESCRIPTION OF THE DRAWINGS

The invention will be better understood upon reading the following description, provided solely as an non-limiting example and done in reference to the appended drawings, in which.

DETAILED DESCRIPTION OF THE PREFERRED EMBODIMENTS

Figure 2:
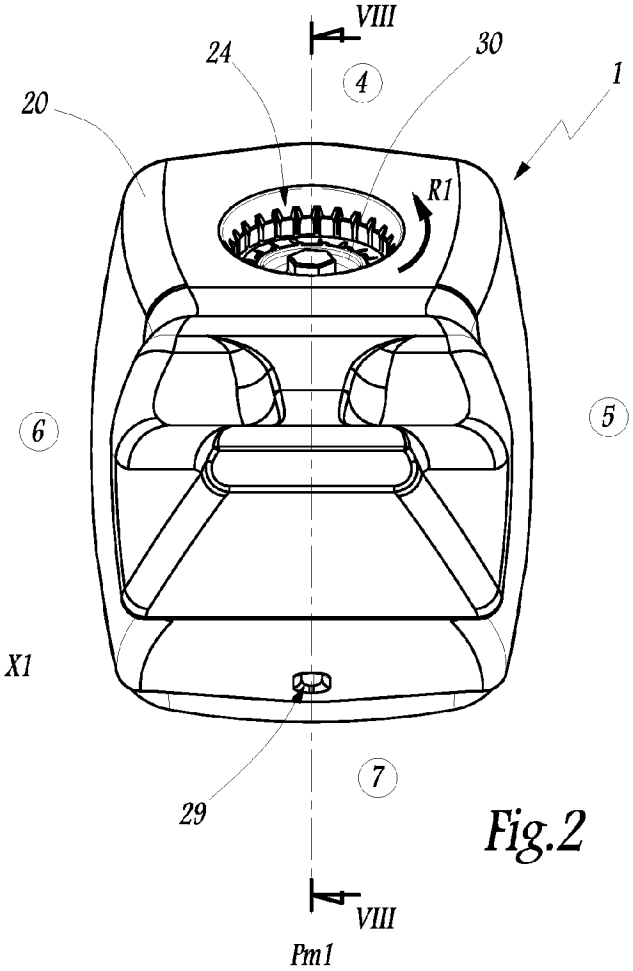
FIG. 2 is a front view of the mechanical system along arrow II of FIG. 1.

FIGS. 1 to 9 show a mechanical system 1 according to the invention, equipping a heavy-construction machine bucket G.

The mechanical system 1 comprises an adapter-support 10, a wearing part 20 of the tooth type, as well as a connection device 30 between the support 10 and the tooth 20. The system 1 extends substantially along an axis X1, along which a first direction D1 for fitting of the tooth 20 on the support 10 is defined as well as a second direction D2, parallel to and opposite the first direction D1, for disassembling the tooth 20.

Figure 1:
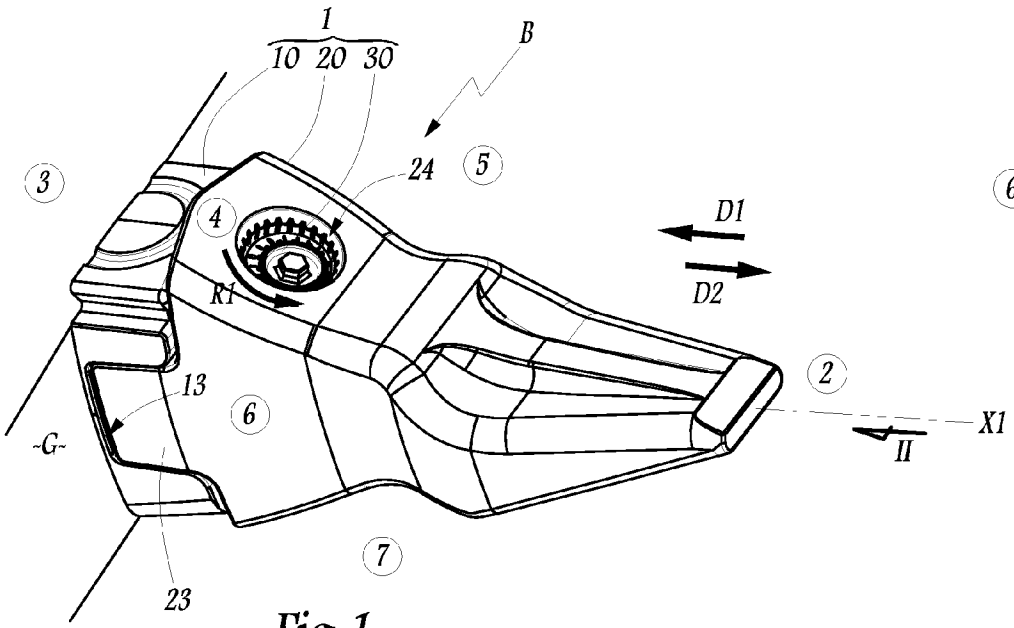
FIG. 1 is a perspective view of a mechanical system according to the invention, comprising a support secured to a bucket that is partially shown, a wearing part, and a connection device for connecting the wearing part and the support, said connection device being shown in the locked configuration and comprising a sheath, a threaded key, a nut and a bearing ring.
Figure 3:
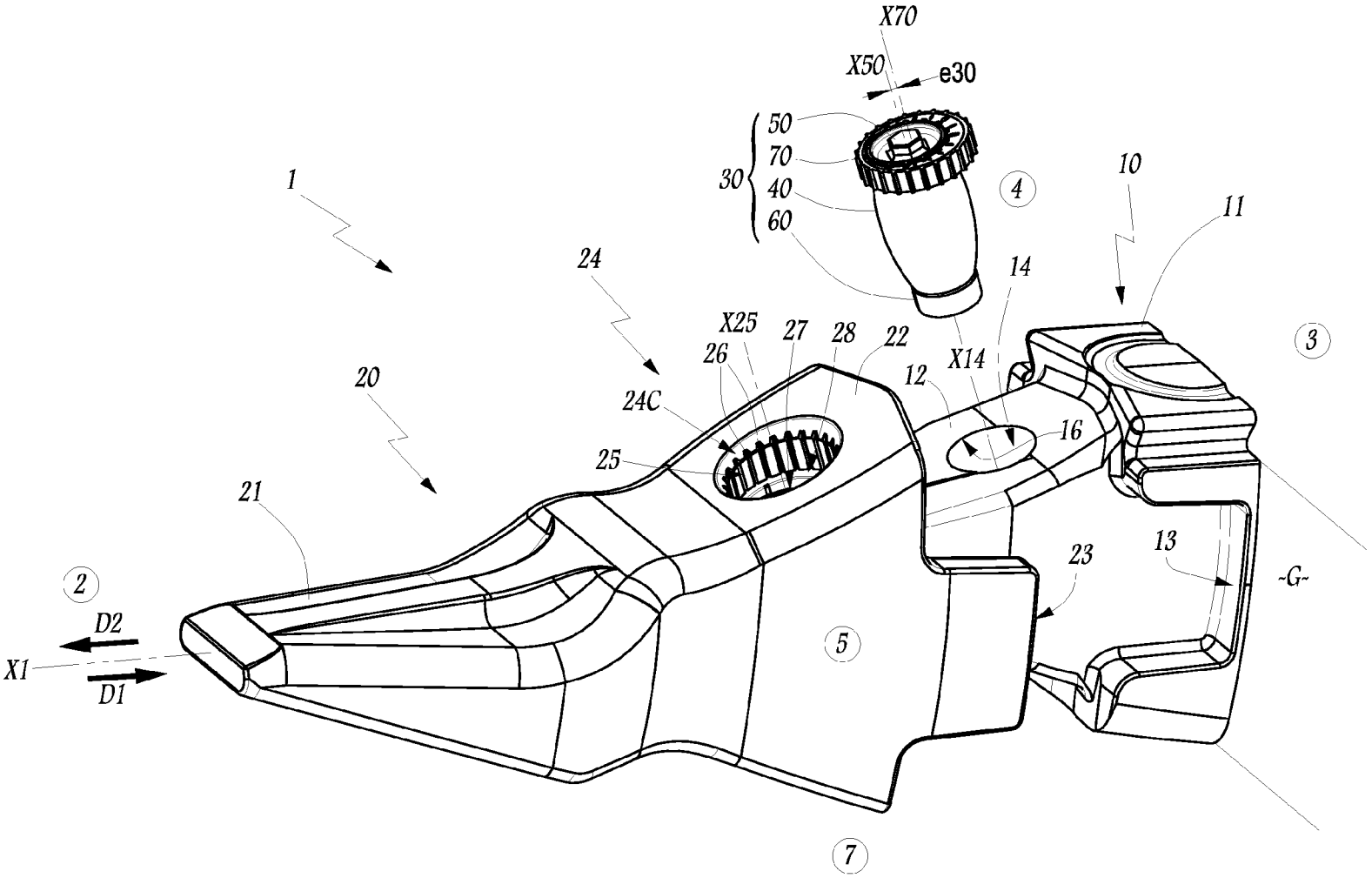
FIG. 3 is another perspective view, exploded, of the mechanical system of FIG. 1.
Figure 4:
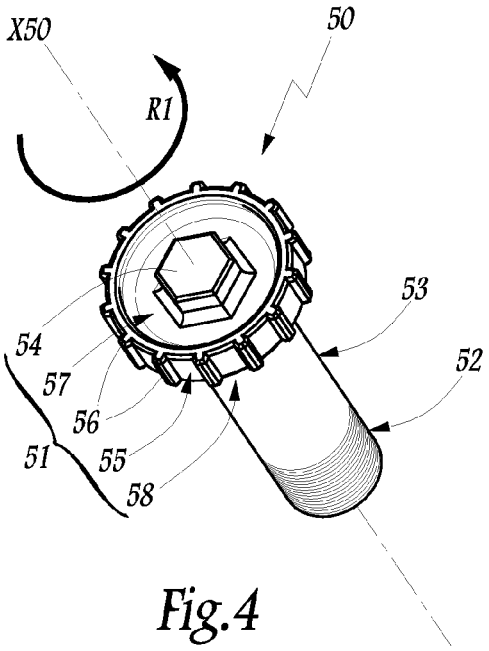
FIG. 4 is a perspective view of the key belonging to the connection device.
Figure 5:
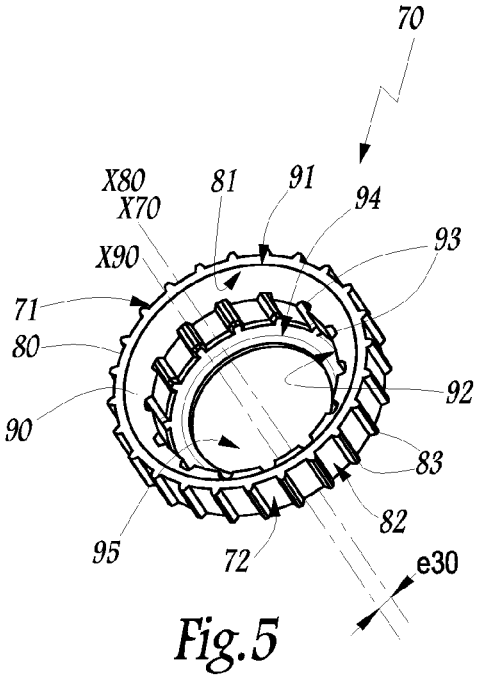
FIG. 5 is a perspective view of the bearing ring belonging to the connection device.
Figure 6:
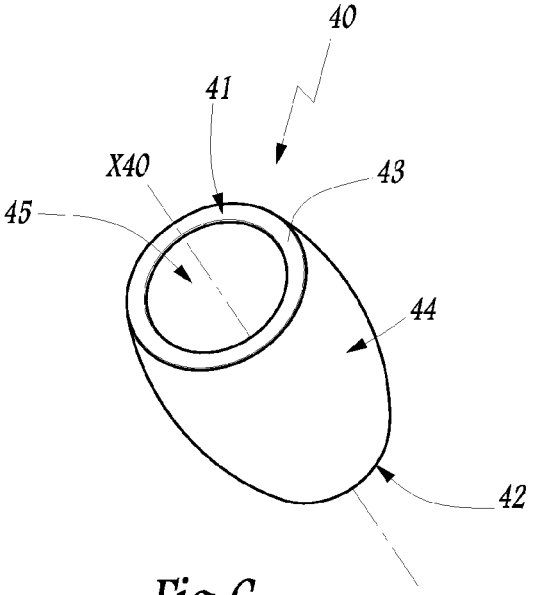
FIG. 6 is a perspective view of the sheath belonging to the connection device.
Figure 7:
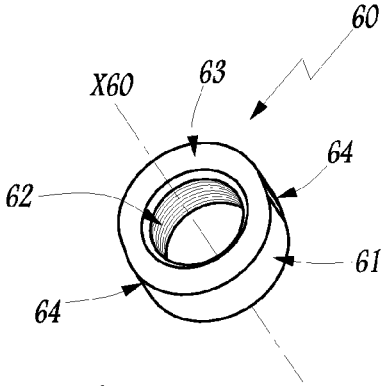
FIG. 7 is a perspective view of the nut belonging to the connection device.

The bucket G is partially shown in FIGS. 1 and 3, for simplification purposes. The support 10 is secured to the bucket G, while the tooth 20 is a wearing part designed to be disassembled when it is too worn by the operation of the bucket G.

The connection device 30 comprises a sheath 40, a threaded key or screw 50 that passes through the sheath 40, as well as a nut 60 and a bearing ring 70 positioned on either side of the sheath 40 and cooperating with the key 50. The device 30 may be inserted into a housing 14 of the support 10, in an insertion configuration A shown in FIG. 8. The relative screwing of the nut 60 and the key 50, in a direction of rotation R1, deforms the sheath 40 inserted between them, from the insertion configuration A to a locked configuration B shown in FIGS. 1 and 9.

Thus, the device 30 is adjustable between the insertion configuration A, where the sheath 40 is not in contact or is only partially in contact with the housing 14 while the device 30 does not exert any retaining force on the tooth 20, on the one hand, and the locked configuration B, where the sheath 40 is adjusted in the housing 14 of the support 10, while the device 30, more specifically the bearing ring 70, bears against the tooth 20, thereby forming a coupling connection between the tooth 20 and its support 10.

To facilitate the identification of the different parts of the mechanical system 1 spatially, defined are: a front side 2 at which the tooth 20 is situated, a rear side 3 at which the support 10 is situated, and an upper side 4 that is oriented opposite the ground when the system 1 is assembled and from which the device 30 is inserted into the support 10, a left side 5 and a right side 6 localized relative to the disassembly direction D2, as well as a lower side 7 oriented toward the ground when the system 1 is assembled.

Figure 8:
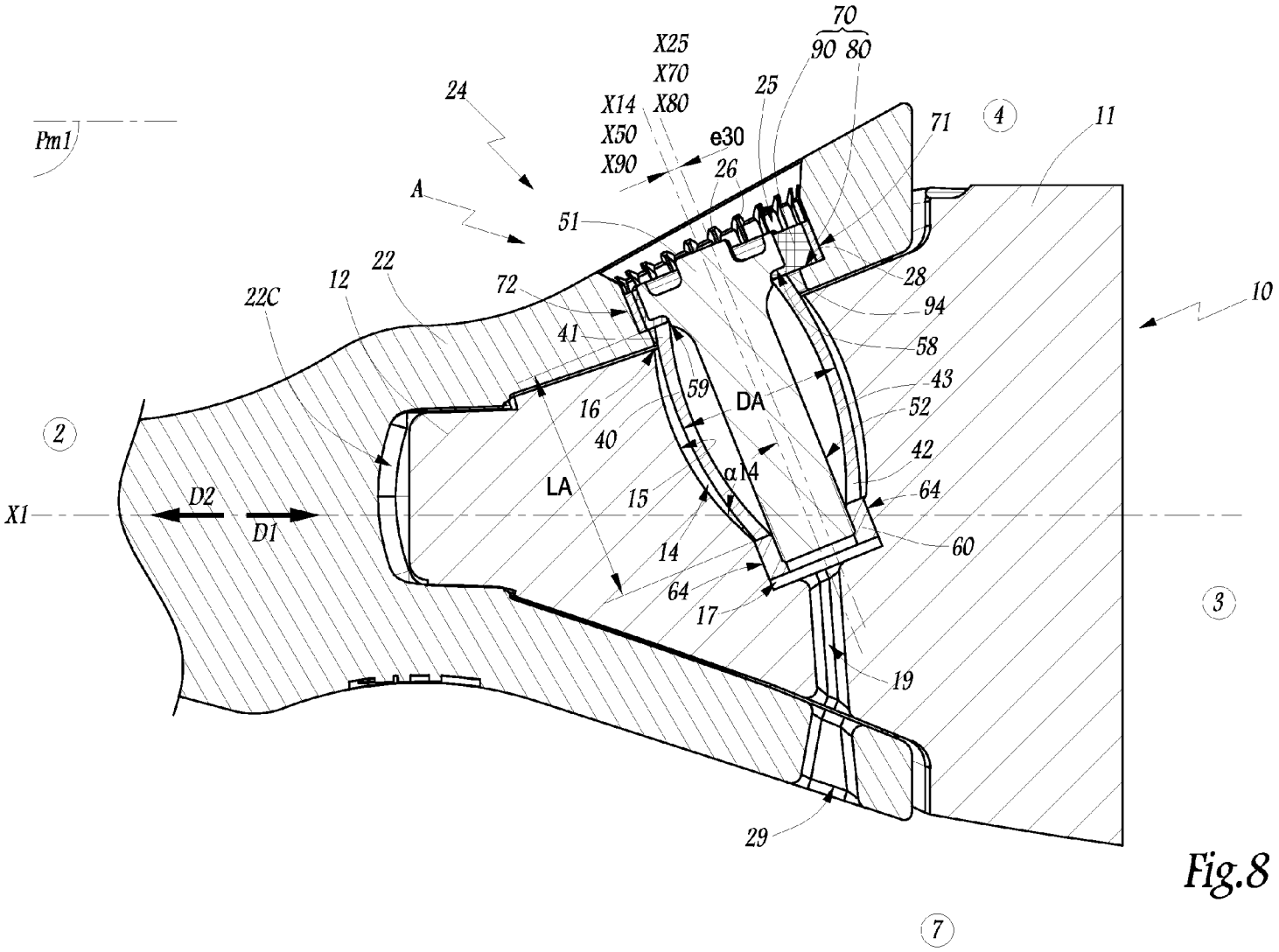
FIG. 8 is a cross-section along line VIII-VIII in FIG. 2, showing the mechanical system and the connection device in an insertion configuration.
Figure 9:
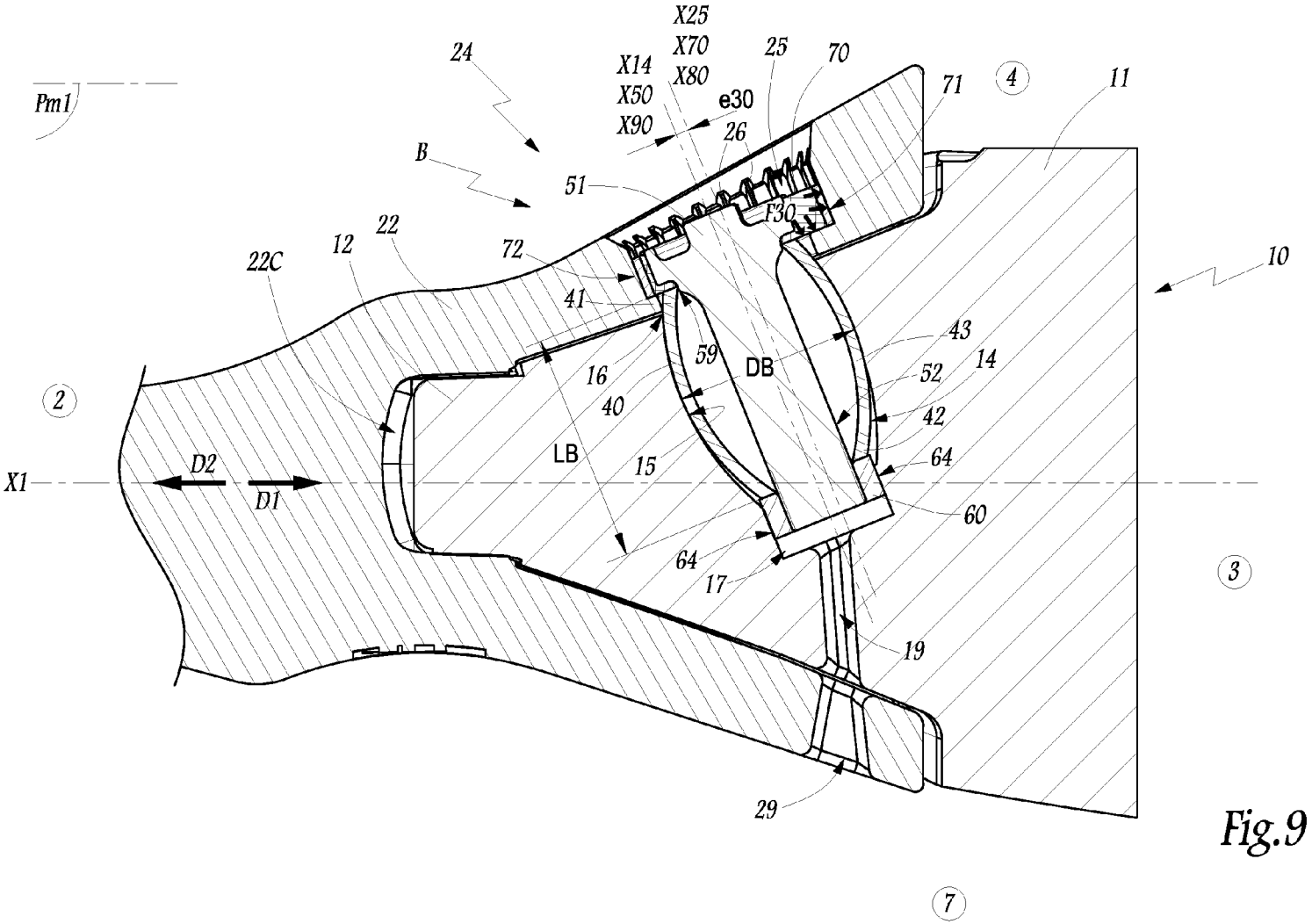
FIG. 9 is a cross-section similar to FIG. 8, showing the mechanical system and the connection device in the locked configuration.

The support 10 comprises a base 11, partially shown in FIGS. 1 to 3, 8 and 9. The support 10 also comprises a fitting nose 12 provided to be engaged in a cavity 22C of the tooth 20 configured to that end, as shown in FIGS. 8 and 9. Furthermore, a housing 13 for receiving lugs 23 of the tooth 20 is formed on each side 5 and 6 of the base 11. Each housing 13 includes walls situated toward the back 3, the top 4 and the bottom 7. The housing 13 is opened toward the front 2 so as to receive the lugs 23.

The housing 14 is formed in the nose 12 of the support 10, along an axis X14 inclined by an angle α14 relative to the axis X1, between the inside of the nose 12 and an opening 16 emerging on the upper side 4. As a non-limiting example in particular shown in FIGS. 8 and 9, the angle α14 is equal to 70°, preferably comprised between 50° and 90°. The angle α14 is measured opposite the base 11 relative to the point of intersection of X1 and X14. The housing 40 includes an inner wall 15 for adjusting the sheath 40 on the one hand, and a part 17 for receiving the nut 60, which is received in the nose 12 opposite the opening 16, on the other hand. The wall 15 forms an ellipsoid of revolution around the axis X14, truncated at the opening 16 and the part 17. The part 17 has a substantially cylindrical shape centered on the axis X14 and is provided with two flats, not shown and diametrically opposite relative to the axis X14, to block the rotation of the nut 60. Preferably, a conduit 19 for guiding a tool for unlocking the nut 60 extends parallel to the part 17 and the lower side 7 of the nose 12, as shown in FIGS. 8 and 9.

The tooth 20 comprises an active part 21 situated toward the front 2 and a hollow part 22 oriented toward the rear. In a known manner, the part 21 is provided to scrape and remove materials, for example dirt or gravel, while the part 22 is provided for fitting of the tooth 20 on the support 10. More specifically, the part 22 comprises the inner cavity 22C, shown in FIGS. 8 and 9, configured for fitting on the nose 12 of the support 10, as well as the lugs 23 that are oriented toward the rear 3 and provided to be received in the housings 13, in contact with the top 4 and the bottom 7, as shown in FIG. 1.

A through orifice 24 is formed in the hollow part 22 of the tooth 20, between the upper side 4 and the cavity 22C. This orifice 24 is positioned across from the opening 15 of the housing 14 when the tooth 20 is fitted on the support 10, thereby allowing the device 30 to be inserted into the housing 14, then the device 30 to be used. As shown in particular in FIGS. 3, 8 and 9, the orifice 24 comprises a first part 25 provided with a cylindrical side surface in which slots 26 are formed, a second cylindrical part 27 emerging in the cavity 24C, as well as a transverse shoulder 28 connecting the parts 25 and 27. The part 25 is globally centered on an axis X25, the shoulder 28 extends radially to the axis X25, while the part 27 is slightly off-centered toward the front 2 relative to the axis X25. The slots 26 extend radially and parallel to the axis X25. The radial dimensions of the part 27 are smaller than the radial dimensions at the axis X25 of the part 25, such that the shoulder 28 is turned toward the upper side 4. A bevel 24C is arranged on the side 4, between the part 25 and the outside of the orifice 24, to facilitate the insertion of the device 30. The slots 26 emerge from the part 25 in the bevel 24C. The orifice 24 is provided to receive the device 30, more specifically the bearing ring 70, bearing against the tooth 20, in the locked configuration B described below.

Preferably, a conduit 29 for guiding a tool for unlocking the nut 60 extends between the cavity 22C and the lower side 7 of the part 22, as shown in FIGS. 3, 8 and 9. The conduit 29 is substantially aligned with the conduit 19 when the system 1 is assembled, thereby allowing the tool to be inserted as far as the inside of the part 17 of the housing 14.

When the system 1 is assembled, with the tooth 20 fitted on the support 10, the axes X1, X14 and X25 are situated in the same median plane Pm1 of the system 1. More specifically, the axis X25 is offset parallel and radially to the axis X14, according to a gap e30 toward the rear 3.

The sheath 40 is made from an elastically deformable material, for example an elastomer. As in particular shown in FIG. 6, the sheath 40 is elongated between longitudinal ends 41 and 42 along a central axis X40. In the insertion configuration A, the end 41 is situated on the side 4, whereas the end 42 is situated on the side 7. This distinction is made for spatial identification purposes only, given that the ends 41 and 42 are reversible. The sheath 40 comprises a wall 43 that is centered on the axis X40 and curved radially opposite the axis X40. The wall 43 delimits an outer surface 44 forming an ellipsoid of revolution around the axis X40, truncated at the ends 41 and 42. The wall 43 also delimits an inner cavity 45, which is centered on the axis X40, emerging at the ends 41 and 42 and provided to receive the key 50, with a radial gap formed between the sheath 40 and the key 50. In practice, the wall 15 and the outer surface 44 have substantially complementary shapes in the locked configuration B, such that the wall 43 of the sheath 40 can be adjusted in the housing 14 of the support 10 by hugging its inner contours defined by the wall 15.

The key 50 is made from metal, for example steel. As shown in particular in FIG. 4, the key 50 comprises a body 53 elongated along an axis X50 between a head 51 and a threaded foot 52. More specifically, the head 51 comprises a hexagonal part 54 for being actuated by a tool, not shown for simplification purposes, an outer cylindrical part 55 provided with rigid ribs 56, a recess 57 formed between the parts 54 and 55 to facilitate the access of the tool to the part 54, and a lower bearing part 58 forming the shoulder oriented toward the foot 52. The ribs 56 extend radially and parallel to the axis X50 and are provided to cooperate with the bearing ring 70. The center of gravity of the key 50 is situated on the axis X50. With the exception of the threading of the foot 52, the part 54 and the ribs 56, the key 50 is a piece of revolution around the axis X50, with no off-centered part.

The nut 60 is made from metal, for example steel similar to that of the key 50. As shown in particular in FIG. 7, the nut 60 comprises a cylindrical outer surface 61 and a tapped inner bore 62 that are centered on an axis X60 and connected by a shoulder 63 radial to the axis X60. The tapping of the bore 62 is complementary to the threading of the foot 52 of the key 50. The shoulder 63 is provided to receive the end 42 of the sheath 40 by bearing. Flats 64, diametrically opposite relative to the axis X60, are formed in the surface 61. The surface 61 is configured to be received in the part 17 of the housing 14, with the flats 64 that cooperate, both in the insertion configuration A and in the locked configuration B, with the corresponding flats formed in that part 17. The axis X60 is then aligned with the axis X14. The nut 60 housed in the part 17 is therefore translatable along the axis X14, but locked in rotation around the axis X14.

The bearing ring 70 has a global cylindrical shape centered on an axis X70. As shown in particular in FIG. 5, the ring 70 is formed by a rigid outer part 80 that is adjustable in the orifice 24, as well as an elastically deformable inner part 90 in which the key 50 may be positioned. For example, the part 80 is made from metal, while the part 90 is made from elastomer.

The part 80 comprises a thin wall delimited by an inner cylindrical surface 81 and by an outer cylindrical surface 82 that is provided with ribs 83. The surfaces 81 and 82 are centered on an axis X80 that is combined with the axis X70. The ribs 83 extend radially and parallel to the axis X80 and are provided to be housed in the slots 26 of the orifice 24.

The part 90 comprises an outer cylindrical surface 91, an inner cylindrical surface 92 provided with slots 93, and a radial stop 94. The surface 91 is centered on the axis X70, while the surface 92 is centered on an axis X90 offset radially and parallel to the axis X70. Thus, the part 90 is thicker radially to the axis X70 on one side 71 of the ring 70 and centered on one side 72, diametrically opposite the side 71, of the ring 70. The slots 93 extend radially and parallel to the axis X90 and are provided to receive the ribs 56 of the key 50. The stop 94 is centered on the axis X90 and extends radially toward the axis X90 from one of the axial borders of the surface 92. This stop 94 radially delimits an orifice 95 centered on the axis X90 and passing through the ring 70 along the axis X90.

The part 80 and the part 90 of the ring 70 may be assembled by gluing or thermofusing of the surfaces 81 and 91.

The operation of the connection device 30 equipping the mechanical system 1 is described below.

In a first step a), an operator assembles the connection device 30. First, the key 50 is received in the bearing ring 70. The foot 52, then the body 53 pass through the orifice 95, until the head 51 is housed in the part 90. The part 55 is adjusted against the surface 92, the ribs 56 are engaged in the slots 93, and the shoulder 58 bears against the stop 94, as shown in FIG. 8. Next, the operator positions the sheath 40 on the key 50. The body 53 is positioned in the cavity 45 and is surrounded by the wall 43, while the end 41 abuts against the stop 94 on the side opposite the shoulder 85. Lastly, the operator positions the nut 60 at the end of the key 50, with the shoulder 63 and the shoulder 58 facing each other. The tapping 62 is screwed on the threaded foot 52, with the sheath 40 inserted between the ring 70 and the nut 60. The end 41 bears against the stop 94, while the end 42 bears against a shoulder 63. Furthermore, the wall 43 is adjusted radially to the axis X40, on the one hand at the end 41, on a notch 59 formed in the key 50 between the body 53 and the shoulder 58, and on the other hand at the end 42, on the threaded foot 52.

The connection device 30 is then assembled, as shown in FIGS. 3, 8 and 9, with the axes X40, X50, X60 and X90, which are combined. Subsequently, these axes are designated together using reference X50. Conversely, the axis X70 is offset from the side 71 radially and parallel to the axis X50. In other words, the ring 70 is off-centered relative to the axis X50. In particular, the gap between the axes X50 and X70 is equal to the gap e30 between the axes X14 and X25, as shown in FIGS. 8 and 9.

In a second step b), the operator positions the tooth 20 on the support 10, with the active part 21 oriented so as to be able to scrape and remove materials during operation of the system 1. The hollow part 22 is fitted on the nose 12, with complementary planes bearing against each other. The lugs 23 are received in the housings 13 of the base 11. The orifice 24 is placed across from the opening 16 of the housing 14 on the side 4, such that the housing 14 is accessible to insert the device 30 in the insertion configuration A.

In a third step c), the operator positions the preassembled connection device 30 in the housing 14 of the support 10. The device 30 passes through the orifice 24, then the opening 16 situated on the side 4, starting with the nut 60 and ending with the head 51 and the ring 70, with the wall 43 of the sheath 40 slightly centripetally deforming as it passes through the opening 16. The orientation of the ring 70 by the operator is important at this stage: the side 71 is oriented toward the rear 3, the side 72 is oriented toward the front 2, and the ribs 83 are received in the slots 26 of the orifice 24. Markers, not shown for simplification purposes, may be formed on the part 22 and the device 30 to facilitate the orientation. The nut 60 and its flats 64 become housed in the part 17 of the housing 14, while the bearing ring 70 is adjusted in the orifice 24, abutting against the shoulder 28.

The device 30 is then in the insertion configuration A, as shown in FIG. 8. The length of the key 50 along the axis X50 is such that the head 51 does not protrude outside the orifice 24 and is therefore protected. The outer surface 44 of the sheath 40 is not in contact, or is only partially in contact, with the surface of the housing 14. A length LA of the sheath 40 is delimited by the axial separation between the ends 41 and 42 of the sheath 40, in other words, between the shoulder 63 and the stop 94, along the axis X50. Furthermore, a maximum diameter DA of the sheath 40 is delimited around the key X50 by the surface 44. At this stage, the axes X14, X25, X50 and X70 are situated substantially in the median plane Pm1, containing the axis X1, of the system 1. Nevertheless, except at the nut 60 and the flats 64, the connection device 30 is released in the system 1 and can be removed from the housing 14. In fact, while mechanical stresses are exerted on the active part 21 of the tooth 20, in particular a deflation force oriented toward the bottom 7, the part 22 tends to become unfitted from the nose 12. In particular, when the orifice 24 is pulled toward the front 2 and the top 4, a deformation of the wall 43 and the part 90 may cause the connection device 30 to be removed from the housing 14. In other words, the device 30, more specifically the sheath 40 and the ring 70, do not exert sufficient retaining forces on the tooth 20 in the insertion configuration A, such that the relative positions of the support 10 and the tooth 20 are not locked.

In a fourth step d), the operator deforms the sheath 40 and the housing 14 by screwing the key 50 in the nut 60. More specifically, the operator uses a tool to exert a screwing torque, around the axis X50 in the direction of rotation R1, on the part 54 of the head 51, such that the threaded foot 52 penetrates the tapping 62. The direction of rotation R1 may be identified by a marking, not shown for simplification purposes, on the head 51 of the key 50, so as to facilitate the operator's task. During screwing of the key 50, the rigid ribs 56 are rotatable R1 around the key axis X50 by elastically deforming the ribs 93 formed in the part 90 of the ring 70. That part 90 is made from elastically deformable material rigid enough to withstand several mounting and disassembly operations of the device 30, and therefore several screwing and unscrewing operations of the head 51. At the same time, the ribs 83 and complementary slots 26 constitute anti-rotation securing elements of the ring 70 relative to the orifice 24.

Thus, the device 30 goes from the insertion configuration A to the locked configuration B. The key 50 is locked axially along the axis X50, unlike the nut 60, which may translate in the part 17. The screwing rotation R1 of the key 50 gradually brings the nut 60 closer to the head 51, such that the sheath is compressed along the axis X50 between the shoulder 63 and the stop 94. The wall 43 deforms with an accentuation of its curvature in the middle part, i.e., an intermediate part between the shoulder 63 and the stop 94. The outer surface 44 of the sheath 40 gradually bears against the inner wall 15 of the housing 14.

Lastly, in a fifth step e), the operator stops the screwing of the device 30 in the locked configuration B, shown in FIG. 9. The key axis X50 is then substantially aligned with the central axis X14 of the housing 14, while the axis X70 is substantially aligned with the axis X25. The wall 43 of the sheath 40 is adjusted in the housing 14 of the support 10, with the surface 44 hugging the contours of the wall 15. A length LB of the sheath 40, which is smaller than the length LA, is delimited by the axial separation between the ends 41 and 42 of the sheath 40 along the axis X50. Furthermore, a maximum diameter DB of the sheath 40, which is larger than the diameter DA, is delimited around the key X50 by the surface 44. The deformation of the wall 43, in a radial expansion direction, is no longer possible, such that the sheath 40 has a compression strength, and therefore screwing strength, that is perceptible by the operator.

In the locked configuration B, the sheath 40 is adjusted in the housing 14, the head 51 presses the ring 70 in the orifice 24 in the direction of the housing 14, and the bearing ring 70 retains the tooth 20, thereby forming a coupling link between the tooth 20 and the support 10. In particular, during an attempt to move the tooth 20, the device 30 exerts retaining forces on that tooth 20 by means of the bearing ring 70, with the ribbed surface 80 to the retains the slotted surface 25, while the stop 94 and the part 80 retain the shoulder 28. In other words, the ring 70 then exerts retaining forces on the part 25 and the shoulder 28 of the orifice 24, in particular on the side 71. These retaining forces are shown by a group of arrows F30 in FIG. 9. The sheath 40 is made from a deformable material rigid enough to prevent or reduce the movements of the device 30 in the housing 14. Additionally, a metal insert may be molded in the wall 43 of the sheath 40. The sheath 40 may no longer be removed from the housing 14 and the head 51 is rigidly maintained by the end 41, which grips the notch 59. The only possible movement inside the device 30 is a slight deformation of the part 90 of the ring 70. The device 30 cannot be removed from the housing 14 and the tooth 20 is pressed against the support 10.

Furthermore, in an alternative that is not shown, the housing 14 and the opening 16 may be offset toward the rear 3 relative to the orifice 24, so as to accentuate the retaining forces exerted by the device 30 in the orifice 24 in the locked configuration B. In fact, if the wall 43 of the sheath 40 bears against the wall 15 of the housing 14 first toward the front 2, then toward the sides 4 and 5 and the rear 3, the head 51 of the key 50 exerts additional forces on the bearing ring 70, which retransmits those retaining forces on the part 25 and the shoulder 28 of the tooth 20.

Thus, when mechanical stresses are exerted on the active part 21, the part 22 of the tooth 20 is firmly retained in the usage position simultaneously by the connection device 30 in the locked configuration B, by the nose 12, and by the walls of the housings 13 receiving the lugs 23.

Subsequently, in a disassembly step f), the operator can use the tool to unscrew the device 30 in a direction opposite the direction of rotation R1. The wall 43 of the sheath 40 contracts, and the forces exerted by the device 30 on the tooth 20 and in the support 10 are released, from the locked configuration B toward the insertion configuration A. Next, the device 30 may be removed from the system 1, eliminating the coupling connection between the tooth 20 and the support 10. Thus, the device 30 allows the tooth 20 to be disassembled without a hammer, after wearing of said tooth, through operations opposite the mounting operations.

During this step f), the device 30 may sometimes be locked in the housing 14, for example if dirt has become housed in the orifice 24 during operation of the system 1. In that case, the operator may insert a tool through the conduits 19 and 29 until reaching the inside of the housing 14, more specifically until reaching the inside of the part 17 for receiving the nut 60. The tool then exerts a thrust toward the top 4 on the nut 60 and/or the threaded foot 52 of the key 50, thereby unlocking the device 30 so that it can be removed from the housing 14.

The component elements of the system 1 and the connection device 30 may be configured differently without going beyond the scope of the invention. In practice, the component elements of the device 30 are specifically designed to withstand the wear of the system 1 during operation, as well as to withstand several assembly and disassembly operations using the tool.

In an alternative that is not shown, the ribs and slots, in other words the toothings, of the orifice 24, the ring 70 and the key 50 may have different shapes and arrangements suitable for the present application. For example, there may be a higher or lower number of ribs 56 distributed on the perimeter of the head 51. According to another example, the slots 26 formed on the perimeter of the orifice 25 may have a triangular shape in cross-section in a plane perpendicular to the axis X25. The ring 70 is then suitable for the aforementioned alternatives.

According to another alternative that is not shown, the part 90 of the ring 70 can be arranged to facilitate its deformation during the rotation R1. For example, the part 90 may include localized recesses, distributed on the side 71 between the surfaces 91 and 92, producing targeted weakening of the part 90.

According to another alternative that is not shown, the housing 14, the opening 16 and the orifice 24 may be more or less offset relative to one another.

According to another alternative that is not shown, the housing 14 may be formed in the nose 12 in a direction perpendicular to the current axes X1 and X14, to emerge at one of the housings 13. In that case, the orifice 24 is formed in the corresponding lug 23 of the tooth 20, across from the housing 14.

According to another alternative that is not shown, the part 54 for actuating the key 50 using a tool may be configured differently.

According to another alternative that is not shown, a metal insert may be arranged between the sheath 40 and the key 50, or may be molded directly in the wall 43.

Furthermore, the technical characteristics of the different embodiments may be combined with each other in whole or in part. Thus, the connection device may be adapted in terms of cost and performance.

The invention claimed is:

1. A mechanical system (1) comprising a support (10), a wearing part (20) and a connection device (30) between the wearing part (20) and the support (10), the connection device (30), comprising:

a key (50) including a body (53) that is elongated along a key axis (X50) between a threaded foot (52) and a head (51);

a nut (60) capable of being screwed on the threaded foot (52) of the key (50); and a sheath (40) made from an elastically deformable material, provided with a wall (43) arranged around the body (53) and adjustable by deformation in a housing (14) of the support (10), by screwing (R1) between the threaded foot (52) of the key (50) and the nut (60), between an insertion configuration (A) where the connection device (30) can be removed from the housing (14) and a locked configuration (B) where the wall (43) of the sheath (40) is adjustable in the housing (14), wherein the connection device (30) also comprises a bearing ring (70) inserted between an orifice (24), formed in the wearing part (20) across from a through opening (16) of the housing (14), and the key (50), rotatable in the bearing ring (70) by screwing (R1) around the key axis (X50), wherein in the insertion configuration (A) of the connection device (30), the bearing ring (70) is adjustable in the orifice (24), and wherein in the locked configuration (B) of the connection device (30), the bearing ring (70) exerts retaining forces (F30) on the wearing part (20).

2. The mechanical system (1) according to claim 1, wherein in the locked configuration (B), the bearing ring (70) exerts retaining forces (F30) on a side surface (25) of the orifice (24) and on a through shoulder (28) of the orifice (24).

3. The mechanical system (1) according to claim 1, wherein the orifice (24) and the bearing ring (70) have complementary side surfaces (25, 82) globally centered on a secondary axis (X25) offset by a gap (e30) parallel and radially to the central axis (X14) of the housing (14).

4. The mechanical system (1) according to claim 1, wherein the orifice (24) and the bearing ring (70) include anti-rotation securing elements (26, 83) during screwing (R1).

5. The mechanical system (1) according to claim 1, wherein the head (51) of the key (50) includes rigid ribs (56) that extend radially and parallel to the key axis (X50), and which are engaged in a elastically deformable ribs (93) formed in the bearing ring (70), both in the insertion configuration (A) and the locked configuration (B), and, during screwing (R1) of the key (50), rotatable around the key axis (X50) by elastically deforming the ribs (93) of the bearing ring (70).

6. The mechanical system (1) according to claim 1, wherein the bearing ring (70) comprises:

a rigid outer part (80) that is adjustable in the orifice (24); and an elastically deformable inner part (90) in which the key (50) is positioned, the rigid outer part (80) and the elastically deformable inner part (90) being secured in rotation.

7. The mechanical system (1) according to claim 1, wherein the nut (60) includes at least one flat (64) capable of cooperating, both in the insertion configuration (A) and the locked configuration (B), with a corresponding platform in a part (17) of the housing (14).

8. The mechanical system (1) according to claim 1, wherein the support (10) includes a through conduit (19) into the housing (14) on a side (7) opposite the through opening (16) and the orifice (24), wherein the wearing part (20) includes a through conduit (29) on the side (7) opposite the orifice (24), and wherein the conduit (19) of the support (10) and the conduit (29) of the wearing part (20) are substantially aligned and capable of receiving a tool penetrating inside the housing (14), when the mechanical system (1) is assembled.

9. A heavy-construction machine bucket, comprising at least one mechanical system (1) according to claim 1.

10. A method for implementing a mechanical system (1) according to claim 1, comprising the following steps:

a) assembling the connection device (30);

b) positioning the wearing part (20) on the support (10);

c) positioning the connection device (30) in the housing (14) of the support (10), in the insertion configuration (A) where the bearing ring (70) is adjusted in the orifice (24) and the connection device (30) is removable from the housing (14);

d) deforming the sheath (40) in the housing (14) by screwing (R1) the threaded foot (52) of the key (50) into the nut (60);

e) stopping the screwing (R1) in the locked configuration (B) where the wall (43) of the sheath (40) is adjusted in the housing (14) and the bearing ring (70) exerts retaining forces (F30) on the wearing part (20).

* * * * *